US008070916B2

(12) United States Patent
Scherb et al.

(10) Patent No.: US 8,070,916 B2
(45) Date of Patent: Dec. 6, 2011

(54) DEVICE FOR PRODUCING A WEB OF TISSUE

(75) Inventors: Thomas Scherb, Sao Paulo (BR); Luiz Carlos Silva, Campo Limpo (BR)

(73) Assignee: Voith Patent GmbH, Heidenheim (DE)

( * ) Notice: Subject to any disclaimer, the term of this patent is extended or adjusted under 35 U.S.C. 154(b) by 822 days.

(21) Appl. No.: 10/560,074

(22) PCT Filed: Jun. 9, 2004

(86) PCT No.: PCT/EP2004/051070

§ 371 (c)(1),
(2), (4) Date: Jun. 23, 2006

(87) PCT Pub. No.: WO2004/109011

PCT Pub. Date: Dec. 16, 2004

(65) Prior Publication Data

US 2006/0243404 A1 Nov. 2, 2006

(30) Foreign Application Priority Data

Jun. 11, 2003 (DE) ..... 103 26 304

(51) Int. Cl.

| | |
|---|---|
| ***D21F 7/00*** | (2006.01) |
| ***D21G 3/04*** | (2006.01) |
| ***D21G 9/00*** | (2006.01) |
| ***B65H 23/18*** | (2006.01) |
| ***B65H 18/08*** | (2006.01) |

(52) U.S. Cl. ..... 162/263; 162/252; 162/264; 162/280; 162/283; 162/303; 162/343; 162/358.3; 242/413; 242/413.2; 242/541.4

(58) Field of Classification Search ..... 162/252, 162/263–264, 280–283, 301–303, 336, 343, 162/344, 358.3, 361, 363; 242/410, 413, 413.1–413.3, 541.3–541.4, 532, 610, 610.1, 611.2, 615; 264/282–283; 34/108, 122, 585, 638

See application file for complete search history.

(56) References Cited

U.S. PATENT DOCUMENTS

| | | | | |
|---|---|---|---|---|
| 2,553,154 | A | 3/1951 | Hugo et al. | |
| 3,011,733 | A * | 12/1961 | Ford | 162/255 |
| 3,240,443 | A * | 3/1966 | Nitka | 242/413.2 |
| 3,432,936 | A | 3/1969 | Cole et al. | |
| 3,599,889 | A * | 8/1971 | Pfeiffer | 242/541.6 |

(Continued)

FOREIGN PATENT DOCUMENTS

| | | |
|---|---|---|
| DE | 19745005 | 7/1998 |

(Continued)

*Primary Examiner* — Jose A Fortuna
(74) *Attorney, Agent, or Firm* — Greenblum & Bernstein, P.L.C.

(57) ABSTRACT

Method and device for producing a web of tissue. In the method, the web of tissue is led over at least one drying cylinder, doctored off the latter with a creping doctor and then wound up by way of a winding device. The web of tissue is supported at least largely over the entire distance between creping doctor and winding device on one side by a transfer device, so that there is only a short free web draw, while its other side is free. The device includes at least one drying cylinder, a creping doctor arranged on the drying cylinder and a winding device that winds up the web of tissue. Between the creping doctor and the winding device, a transfer device at least largely bridges the entire distance which supports the web of tissue on one side. There is a short free web draw, but its other side is left free.

63 Claims, 10 Drawing Sheets

U.S. PATENT DOCUMENTS

| | | | | |
|---|---|---|---|---|
| 3,660,226 | A * | 5/1972 | McKeown | 162/264 |
| 3,669,830 | A * | 6/1972 | Williams | 162/264 |
| 4,087,319 | A | 5/1978 | Linkletter | |
| 4,179,330 | A | 12/1979 | Page | |
| 4,321,107 | A | 3/1982 | Page | |
| 4,682,942 | A | 7/1987 | Gotchel et al. | |
| 4,812,209 | A | 3/1989 | Kinzler et al. | |
| 5,645,689 | A | 7/1997 | Ruf et al. | |
| 6,250,580 | B1 * | 6/2001 | Madrzak et al. | 242/533.2 |
| 6,365,004 | B1 * | 4/2002 | Hamstrom et al. | 162/198 |
| 6,451,165 | B1 * | 9/2002 | Doelle et al. | 162/52 |
| 6,494,399 | B1 * | 12/2002 | Rautakorpi | 242/541.7 |
| 6,524,443 | B2 * | 2/2003 | Doelle et al. | 162/264 |
| 6,536,704 | B1 * | 3/2003 | Rautakorpi et al. | 242/534 |
| 6,544,385 | B2 * | 4/2003 | Doelle et al. | 162/52 |
| 6,550,713 | B1 * | 4/2003 | Ruha et al. | 242/541.7 |
| 6,604,703 | B2 * | 8/2003 | Beisswanger et al. | 242/541.4 |
| 6,669,818 | B2 * | 12/2003 | Linden | 162/283 |
| 6,698,681 | B1 * | 3/2004 | Guy et al. | 242/534 |
| 6,709,549 | B2 * | 3/2004 | Berglund et al. | 162/118 |
| 6,719,237 | B2 * | 4/2004 | Wohlfahrt et al. | 242/541.7 |
| 6,755,940 | B2 * | 6/2004 | Lin et al. | 162/205 |
| 6,797,115 | B2 * | 9/2004 | Klerelid et al. | 162/111 |
| 6,880,779 | B1 * | 4/2005 | Heinonen et al. | 242/541.7 |
| 6,998,018 | B2 * | 2/2006 | Klerelid et al. | 162/111 |
| 7,169,259 | B2 * | 1/2007 | Linden | 162/118 |
| RE39,601 | E * | 5/2007 | Svanqvist et al. | 162/193 |
| 7,229,528 | B2 * | 6/2007 | Vinson et al. | 162/111 |
| 7,294,232 | B2 * | 11/2007 | Linden | 162/118 |
| 7,311,805 | B2 * | 12/2007 | Clarke et al. | 162/283 |
| 7,404,875 | B2 * | 7/2008 | Clungeon et al. | 162/111 |
| 7,442,279 | B2 * | 10/2008 | Hermans et al. | 162/118 |
| 7,597,778 | B2 * | 10/2009 | Thoroee Scherb | 162/123 |
| 2001/0052560 | A1 * | 12/2001 | Beisswanger et al. | 242/541.1 |
| 2002/0060036 | A1 * | 5/2002 | Linden | 162/283 |
| 2002/0088588 | A1 * | 7/2002 | Doelle et al. | 162/191 |
| 2002/0092637 | A1 * | 7/2002 | Rouhiainen et al. | 162/272 |
| 2002/0100571 | A1 * | 8/2002 | Mausser et al. | 162/283 |
| 2002/0104630 | A1 | 8/2002 | Dwiggins et al. | |
| 2002/0104917 | A1 * | 8/2002 | Mausser et al. | 242/541.7 |
| 2002/0139499 | A1 * | 10/2002 | Berglund et al. | 162/118 |
| 2002/0148584 | A1 | 10/2002 | Edwards et al. | |
| 2002/0189775 | A1 | 12/2002 | Linden | |
| 2003/0047640 | A1 * | 3/2003 | Wohlfahrt et al. | 242/541.7 |
| 2003/0049380 | A1 * | 3/2003 | Kinnunen et al. | 427/372.2 |
| 2003/0075637 | A1 * | 4/2003 | Bock | 242/541.7 |
| 2003/0111199 | A1 * | 6/2003 | Clarke et al. | 162/193 |
| 2003/0115772 | A1 * | 6/2003 | Juppi et al. | 34/419 |
| 2003/0136018 | A1 | 7/2003 | Herman et al. | |
| 2003/0141403 | A1 | 7/2003 | Eriksson et al. | |
| 2003/0221807 | A1 * | 12/2003 | Klerelid et al. | 162/111 |
| 2004/0074617 | A1 | 4/2004 | Linden | |
| 2004/0074618 | A1 | 4/2004 | Linden | |
| 2004/0074619 | A1 | 4/2004 | Linden | |
| 2004/0226673 | A1 | 11/2004 | Edwards et al. | |
| 2005/0098282 | A1 * | 5/2005 | Scherb | 162/123 |
| 2005/0133176 | A1 * | 6/2005 | Vinson et al. | 162/111 |
| 2005/0145743 | A1 * | 7/2005 | Clarke et al. | 242/535.4 |
| 2005/0156078 | A1 * | 7/2005 | Ragard et al. | 242/534 |
| 2005/0217814 | A1 * | 10/2005 | Super et al. | 162/111 |
| 2005/0245669 | A1 * | 11/2005 | Clungeon et al. | 524/515 |
| 2006/0076116 | A1 * | 4/2006 | Klerelid et al. | 162/111 |
| 2006/0201648 | A1 * | 9/2006 | Clarke et al. | 162/306 |
| 2006/0243404 | A1 * | 11/2006 | Scherb et al. | 162/111 |
| 2007/0074837 | A1 * | 4/2007 | Scherb et al. | 162/205 |
| 2008/0017341 | A1 * | 1/2008 | Maenpaa et al. | 162/198 |
| 2008/0053632 | A1 * | 3/2008 | Scherb et al. | 162/53 |
| 2009/0189008 | A1 * | 7/2009 | Gustavsson | 242/547 |
| 2010/0059192 | A1 * | 3/2010 | Scherb | 162/263 |

FOREIGN PATENT DOCUMENTS

| | | |
|---|---|---|
| DE | 19803798 | 8/1998 |
| DE | 19754878 | 6/1999 |
| DE | 19848816 | 4/2000 |
| DE | 19852257 | 5/2000 |
| DE | 19962706 | 6/2001 |
| DE | 20103070 | 6/2001 |
| DE | 10009897 | 9/2001 |
| DE | 10017038 | 10/2001 |
| DE | 69711593 | 9/2002 |
| DE | 10157451 | 6/2003 |
| EP | 0003377 | 8/1979 |
| GB | 2235705 | 3/1991 |
| GB | 2305156 | 4/1997 |
| WO | 00/20685 | 4/2000 |
| WO | 03/062528 | 7/2003 |
| WO | WO 03091499 A1 * | 11/2003 |
| WO | WO 2004109011 A2 * | 12/2004 |
| WO | WO 2006015918 A1 * | 2/2006 |

* cited by examiner

PRIOR ART

DEVICE FOR PRODUCING A WEB OF TISSUE

BACKGROUND OF THE INVENTION

1. Field of the Invention

The present invention relates to a method for producing a web of tissue, in which the web of tissue is led over at least one drying cylinder, doctored off the latter with a creping doctor and then wound up by way of a winding device.

Furthermore, the present invention relates to a device for producing a web of tissue, having at least one drying cylinder, a creping doctor arranged on the drying cylinder and a winding device for winding up the web of tissue.

The aforementioned web of tissue can, in particular, be tissue grades such as toilet paper, cleaning cloths for the face, napkin paper and the like. In particular in the case of these grades of tissue, what is concerned, inter alia, are the specific volume ("bulk", measured in $cm^3/gm$), which should be as high as possible, and what is known as the "hand feel", which is a measure of how pleasant the tissue feels when handled. Since this measure depends on the subjective sense of the user, there is as yet no objective measurement method. Properties such as softness, velvetiness and a flat surface topography promote a high degree of "hand feel". A "hand feel" value is determined as a result of the subjective assessment of a large number of testing persons.

In addition a certain minimum strength, which matches the requirements of the user, is important for a tissue product.

2. Discussion of Background Information

A number of concepts for tissue machines have already been proposed which, in general, have the object of improving the tissue properties. The object of the present invention is to provide an improved method and an improved device of the type mentioned at the beginning. In particular, the quality of the tissue, the production speed and the runability of the device are to be improved.

SUMMARY OF THE INVENTION

In a method of the type mentioned at the beginning, this is achieved in that the web of tissue is supported at least largely over the entire distance between creping doctor and winding device on one side by a transfer device, so that there is in any case only a short free web draw, while its other side is free.

In a device of the type mentioned at the beginning, this is achieved in that, between the creping doctor and winding device, a transfer device that at least largely bridges the entire distance is provided which supports the web of tissue on one side, so that there is in any case only a short free web draw, but leaves its other side free.

It has been shown that, as a result of supporting the web of tissue with a transfer device between creping doctor and winding device, the runability and the speed of the device can be increased considerably and the quality of the tissue can be improved considerably. On the basis of the development of high-performance hoods, the size of the drying cylinder nowadays is no longer the bottleneck with respect to runability and machine speed in tissue machines. Instead, the difficulty consists in the handling of the free web draw which, in the case of known machines, is attempted to be solved with various threading systems between creping doctor and winding drum.

In a departure from this, the web of tissue, as mentioned, is supported, according to the invention, such that there is any case only a short free web draw. As a result, the problems occurring in the case of long free web draws can be avoided. Here, according to the invention, it has been found that one-sided supporting of the web of tissue is sufficient and the other side of the web of tissue can remain free. This leads to a cost-effective solution and also reduces the susceptibility of the device to faults.

On account of the one-sided supporting of the web of tissue with a maximum free web draw of preferably <1 m, in particular <0.5 m, the result is additionally the possibility of reducing the line force in the winding nip as compared with known methods and devices. For instance, the line force can be reduced from 0.8 kN/m to 0.2 kN/m and less. As a result of this reduction in the line force, with the same hand feel and the same creping structure, a higher specific volume can be achieved or, given the same specific volume, a finer creping structure and a considerably improved hand feel can be achieved. It is also possible to wind up larger jumbo rolls.

As a further advantage, it has been established that the device operates more cleanly, exhibits less paper loss and that the paper can be led off directly when threaded into the pulper.

The method is particularly suitable for use in the case of tissue with a low basis weight and/or low tensile strength.

A suitable structure results if the transfer device is arranged on the underside of the web of tissue and, in particular, begins underneath the creping doctor.

According to the invention, the transfer device used can, in particular, be a belt, an embossing belt, a felt, an embossing felt, a membrane or a fabric. In this case, the transfer device is preferably led through the winding nip of the winding device with the web of tissue. In this way, the supporting of the web of tissue is carried out until the latter is transferred to the spool, so that, in any case during the transfer from the drying cylinder, there is a short free web draw.

The membrane used can in particular be a Spectra membrane, as described, for example, in GB 2 305 156 A in conjunction with FIG. 3 there and also in GB 2 235 705 B. The two aforementioned documents are hereby incorporated by reference in the content of the present application.

The transfer device used can be a transfer belt, in particular, a TAD belt, which is produced by weaving. The fabric forming the transfer belt is distinguished by specific parameters, which can be varied in order to design the transfer belt specifically for the respective intended purpose and in order to achieve specific effects.

These parameters include, for example, the height of the knuckles, at which the warp threads and weft threads lie on one another, the percentage of the area assumed by these knuckles (knuckle area), the type of woven fabric and the permeability.

The height of the knuckles can lie in the range from 0.15 to 0.7 mm and, in a preferred exemplary embodiment, is 0.35 mm.

The area occupied by the knuckles (knuckle area) preferably lies in the range from 7% to 30% and is preferably 25%. The permeability preferably lies in the range from 500 cfm to 750 cfm and is preferably 650 cfm.

In the following table, characteristics of various types of woven fabric which are suitable for TAD belts are specified. The thickness of the woven fabric can be reduced, for example by half, in a further operation by way of a grinding or lapping.

| | | | M-Weave | | | | G-Weave | | |
|---|---|---|---|---|---|---|---|---|---|
| Fabric type | DSP 352 | Q-625 | 36-Mesh | 44-Mesh | 44-Mesh | 58-Mesh | 44-Mesh | 44-Mesh | 50-Mesh |
| No. of meshes (/inch) | 49 × 40 | 48 × 16 | 36 × 32 | 42 × 28 | 42 × 32 | 58 × 44 | 42 × 31 | 43 × 34 | 53 × 43 |
| Warp threads (mm) | 0.35 | 0.27 × 0.56 (smooth yarns) | 0.40 | 0.35 | 0.35 | 0.27 | 0.35 | 0.35 | 0.30 |
| Weft threads (mm) | 0.40 | 0.70 | 0.41 | 0.45 | 0.41 | 0.35 | 0.45 | 0.41 | 0.35 |
| Caliper or thickness (inch) | 0.049 (unground) | 0.0528 | 0.037 | 0.039 | 0.036 | 0.031 | 0.035 | 0.033 | 0.030 |
| Permeability (cfm) | 650 | 625 | 725 | 525 | 525 | 625 | 600 | 600 | 650 |
| Fiber support index (FSI) | | | 45/40 | 51/47 | 57/49 | 65/60 | 55 | 59 | 63 |
| Percentage of open area | 17.8% | | | | | | | | |

According to further refinement of the invention, which is also claimed independently, the web of tissue is subjected to a patterning process in the winding nip. As a result of this patterning process in the winding nip, the quality of the tissue is likewise improved, in particular, in that a large part of the tissue remains unpressed during the winding operation or is pressed only slightly.

In order to achieve such a patterning process in the winding nip, it is preferred to use a structured material, in particular, a TAD belt, as the transfer device. If this TAD belt is led through the winding nip together with the web of tissue, pressing of the web of tissue during the winding process is carried out substantially only in the elevated regions of the belt which, for example, make up only about 25% of the total web area. Therefore, about 75% of the web of tissue remains unpressed or only slightly pressed, which results in the aforementioned quality advantages. In this way, for example, a line force in the winding nip is reduced from 0.8 kN/m to 0.2 kN/m. The hand feel and the creping structure which can be achieved are correspondingly good.

Particularly good results could be achieved with a line force in the winding nip reduced to about 0.2 kN/m or below. In principle, a reduction to virtually 0 kN/m is possible with the method according to the invention.

According to a further refinement of the invention, which is likewise also claimed independently, the web of tissue is subjected to wet forming between drying cylinder and winding device. The quality of the tissue can also be improved in this way.

The wet forming can, in particular, be implemented by the web of tissue being rewetted and having vacuum applied to it in the supported region. As a result of the wetting and application of vacuum, advantageous wet forming can be carried out, as described in the as yet unpublished PCT application number PCT/US03/02108 bearing the priority date Jan. 24, 2002.

Wetting of the web of tissue can be carried out before or at the same time as the application of vacuum. It is preferred for the web of tissue to be wetted on its upper side and to have vacuum applied to its underside. Particularly good wet forming can be achieved thereby.

In order to avoid an excessively high moisture of the web of tissue after the wet forming, the latter can than be dried again, for example by way of infrared, a drying hood and/or at least one drying cylinder.

Good results could be achieved if the dryness at the creping doctor was chosen to be between about 70 and about 100%, in particular, between about 93% and about 98%. However, it is also possible to operate with moist crepe, that is to say with a web of tissue which is moist at the creping doctor, in particular, has a moisture level between 94% and 98% or a moisture level of up to 70%.

The creping rate is preferably chosen to be between about 0% and about 50%, in particular, between about 10% and about 25%. Particularly good results could also be achieved hereby.

According to a further refinement of the invention, the production of the web of tissue is carried out without a threading system. On the basis of the method according to the invention, it is possible to dispense with threading systems, which has advantages with regard to costs and runability.

In order to support the transfer of the web of tissue onto the transfer device, according to a further refinement of the invention, vacuum is preferably applied to said web. The application of vacuum can, in particular, be carried out by a suction roll after the creping doctor.

Another possible way of supporting the transfer of the web of tissue to the transfer device is to blow on the web of tissue after the creping doctor. Various blowing device, for example air jets, can be provided for this purpose.

Threading onto the winding drum can be carried out as in the case of conventional winding drums. As a result, specific means are not required. The winding drum used can be an uncovered or covered roll. Rubber, for example, is suitable as a cover.

Furthermore, a winding drum with a smooth shell, a blind-drilled shell, a drilled shell or a shell provided with grooves can be used. As a result of this open configuration of the roll surface, an influence can be exerted on the air flow around the winding drum and, as a result, the latter can be improved.

A further improvement can be achieved by blowing off paper into a pulper under the winding drum. A pulper can also be used underneath the drying cylinder. The blowing-off action can be carried out, for example, by an air knife or an air shower.

It is likewise advantageous if an air deflector or doctor is used on the winding drum in order to prevent air carried along by the winding drum getting back to the web of tissue.

The present invention can also be combined with an invention for which application was made earlier, so as to provide an improved method and an improved tissue machine of the type mentioned at the beginning with which a tissue product or tissue paper, in particular, "toilet tissue" and "facial tissue" with a particularly high "hand feel" and high specific volume (bulk) with acceptable strength is ensured. In the case of a "facial tissue" with a mass per unit area of, for example, 15 g/m$^2$, the aim is a specific volume (bulk) of 10 cm$^3$/g and higher, and, in the case of a mass per unit area of 23 g/m$^2$, the aim is a specific volume (bulk) of 9.0 $cm^3/g$ and higher. In addition, the construction of the relevant tissue machine should be as simple and cost-effective as possible. At the same time, it should be possible to produce as many different product grades as possible on this machine.

According to the earlier invention, this object is achieved by a method for producing a web of tissue by way of a tissue machine having a headbox and an endless carrier belt. Using this arrangement, the web of tissue is led to a press nip formed between a drying cylinder and a backing unit, the headbox used being a multilayer headbox. At least two grades of stock are supplied to this multilayer headbox and the tissue web is wound up by way of a winding device after the press nip, the hardness of the roll produced preferably being influenced in a predefined way, in particular controlled and/or regulated.

In this case, the drying cylinder used is preferably a Yankee cylinder.

The line force produced in the winding nip is expediently chosen to be less than or equal to 0.8 kN/m.

According to a preferred practical refinement of the method according to the invention, a former having two circulating endless belts is used, which run together, forming a stock inlet gap, and are then led over a forming element, such as, in particular, a forming roll, the inner belt coming into contact with the forming element preferably forming the transport belt. Use is preferably made of a Crescent former, whose inner belt is formed by a felt.

It is also advantageous, in particular, if the web of tissue is led through at least one shoe press together with the carrier belt. In this case, a shoe press unit is expediently used as the backing unit assigned to the drying cylinder.

A high-temperature hood can be provided over the drying cylinder or Yankee cylinder.

A further improvement in the tissue product properties can also be achieved, in particular, by the web of tissue being doctored off the drying cylinder by way of a creping doctor, in particular, a thin creping doctor.

Use is preferably made of one or more of the following grades of stock:

Hardwood fibers, in particular, short-fiber chemical pulps;

Softwood fibers, in particular, long-fiber chemical pulps; and

CTMP (chemical-thermo mechanical pulp).

Mixtures of grades of stock are preferred in which the proportion of hardwood fibers lies in a range from about 50% to about 80%, the proportion of softwood fibers lies in a range from about 20% to about 50%, and/or the proportion of CTMP (chemical-thermo mechanical pulp) lies in a range from 0% to about 20%.

Thus, inter alia, for example the following mixtures of grades of stock are conceivable:

| | Ex. "a" | Ex. "b" | Ex. "c" |
|---|---|---|---|
| Hardwood (50 to 80%) | 50 | 60 | 70 |
| Softwood (20 to 50%) | 30 | 40 | 20 |
| CTMP (0 to 20%) | 20 | 0 | 10 |

Here, in particular, the CTMP in a respective mixture of grades of stock improves the specific volume (bulk).

According to a preferred practical refinement of the method according to the invention, the web of tissue is led around the drying cylinder after the press nip, the drying in the relevant wrap region preferably being intensified by a drying hood, in particular a high-temperature hood.

It is of particular advantage if at least two different grades of stock are supplied to the multilayer headbox and, in this case, short fibers obtained from hardwood are used for the layer of the web of tissue facing the drying cylinder surface, and long fibers obtained from softwood are used for the layer provided on the opposite web side.

It is therefore of particular advantage if the headbox is loaded with at least two layers with different fibrous stocks, the stock with the short fibers obtained from hardwood being added in the layer of the headbox which forms the side of the web of tissue facing the drying or Yankee cylinder surface. The second layer is expediently loaded with long fibers from softwood. Alternatively or additionally, this second layer can also be loaded with long fibers and CTMP and/or with long fibers and also CMP and short fibers. This layer forms the second ply of the web of tissue and faces the drying hood in the drying process. It therefore never comes into contact with the drying or Yankees cylinder surface. By using these method steps, the "hand feel" and "bulk" values are improved by about 5% and more.

A multilayer headbox is preferably used, whose nozzle is subdivided into at least two channels by at least one slat extending over the entire machine width. In this case, the nozzle is expediently subdivided at least substantially symmetrically into two channels by a slat.

Particularly good results are achieved if the slat extends outward beyond the nozzle in the region of the outlet gap. In this way, mixing of the layers is counteracted.

A headbox having sectional dilution water regulation and/or control over the machine width can advantageously be used, in order to be able to establish a respectively desired transverse grammage profile.

In specific cases, it is advantageous if, for at least two layers, dilution water regulation and/or control is provided in each case. For example, when a two-layer headbox is used, it is therefore possible, if appropriate, for dilution water regulation or control to be provided in each case in the two layers.

Dilution water regulation and/or control is preferably provided at least for the layer facing the forming or breast roll. In this case, therefore, relevant dilution water regulation and/or control can, in particular, also be provided only for this one layer, that is to say the outer layer with respect to the forming or press roll. The forming or press roll can be closed, open or else evacuated.

The drying of the web by the drying or Yankee cylinder and a drying or hot air hood are important for the drying process, according to a preferred practical refinement of the method according to the invention, the proportion of the drying provided by the drying hood for drying the web of tissue being chosen to be higher than the proportion of the drying provided by the drying cylinder.

In this case, the ratio between the proportion of the drying of the drying hood and the proportion of the drying of the drying cylinder is advantageously chosen to be greater than 55:45, in particular, greater than or equal to 60:30, in particular greater than or equal to 65:35 and preferably greater than or equal to 70:30.

The drying hood is preferably operated at a temperature which is greater than or equal to 400° C., in particular, greater than or equal to 500° C., in particular, greater than or equal to 600° C. and preferably greater than or equal to 700° C.

The steam pressure in the drying cylinder can additionally be lowered. Thus, a value for the steam pressure in the drying cylinder is advantageously chosen which is less than or equal to 0.7 MPa, in particular, less than or equal to 0.6 MPa and preferably less than or equal to 0.5 MPa.

As a result, the course of the drying can be increased further. By way of the aforementioned measures, an increase in the "bulk" value by up to +5% and an improvement in the "hand feel" value are achieved.

Particular importance is also placed, in particular, on the winding of the web of tissue at the end of the tissue machine.

According to a preferred practical refinement of the method according to the invention, a winding device (reeler) is used in which the web of tissue is led over a carrier drum and is then wound up onto a spool, both the carrier drum and the spool preferably each being assigned a drive. As a result, optimal winding of the web is ensured without destroying the specific volume (bulk) of the paper web produced. Thus, with the use of two drives for the carrier drum and the spool or the wound roll, in particular, a reduction in the line force produced in the winding nip is possible.

According to an expedient practical refinement of the method according to the invention, the line force produced in the winding nip between the carrier drum and the spool is chosen to be less than or equal to 0.8 kN/m, in particular, less than or equal to 0.5 kN/m and preferably less than or equal to 0.2 kN/m. Since no drive power has to be transmitted between the carrier drum and the wound roll, the pressure in the winding nip or contact nip can be reduced.

Since tissue paper is creped, has a high stretch, that is to say a high modulus of elasticity, and a low tensile strength, no substantial web draw can be applied in order to increase the winding hardness of the wound roll.

The maximum difference between the circumferential speed of the roll and the circumferential speed of the carrier roll is preferably less than 10% of the circumferential speed of the carrier roll.

According to a preferred practical refinement of the method according to the invention, the web draw between the drying cylinder and the carrier drum is set to a predefinable desired value, in particular, controlled and/or regulated, via the drive assigned to the carrier drum, irrespective of the line force produced in the winding nip.

Because of the creping on the creping doctor, the carrier drum circumferential speed is lower than the circumferential speed of the drying cylinder.

Advantageously, the drive assigned to the spool is controlled and/or regulated as a function of the speed of the carrier drum.

Of particular importance during the production of a soft roll is the monitoring of the "low" line force in the winding nip or contact nip. According to a preferred practical refinement of the method according to the invention, for this purpose a winding device is used in which the carrier drum is mounted in a fixed position and the spool can be moved. Accordingly, the growth of the roll diameter can be compensated for by way of an appropriate movement of the spool. In addition, the line force in the winding nip can be set in the desired way via the movable spool. A common control loop can advantageously be used to compensate for the roll diameter growth and in order to set the line force in the winding nip. An expedient refinement of the method according to the invention is distinguished by the fact that the line force in the winding nip is determined via at least one force sensor and this line force is regulated by way of moving the spool appropriately. In principle, however, for example the spool can also be fixed in position and the carrier drum can be movable. Furthermore, designs in which both the carrier drum and the spool can be moved are also conceivable.

It is possible that, in the case of low line forces and large, heavy wound rolls, the measurement accuracy of the sensors and the setting accuracy (friction) are no longer sufficient. In particular in the case of line forces in the winding nip which are less than or equal to 0.5 kN/m and in particular less than or equal to 0.2 kN/m, the movable spool is therefore preferably displacement-controlled. In this case, in particular the roll diameter and the position of the spool or the roll formed on the latter relative to the carrier drum are used as measured variables for the displacement control.

According to a further advantageous refinement of the method according to the invention, for the purpose of setting and controlling and/or regulating the line force in the winding nip, the region of the winding nip can be monitored appropriately by way of a CCD camera. In this case, by way of the CCD camera, the respective distance between the carrier drum and the spool or the roll formed on the latter is preferably registered.

By using such an observation of the winding nip region, for example by way of a CCD camera, a further possible way of monitoring and setting the winding force therefore results. It is therefore possible to measure and display the distance between the carrier drum and the wound roll. By using an evaluation of the image, a desired value for the hydraulic cylinder pressure influencing the movable wound roll can then be achieved and the translation or displacement as far as the desired distance or winding force can be carried out via a control device. The gain in bulk can, for example, lie in a range from 4 to 8%. A further advantage is that the gain in "bulk" reached by means of the shoe press is not destroyed and thus the quality of the web is maintained.

It is also advantageous, in particular, if the drive assigned to the spool and therefore to the wound roll is not changed during the winding operation, that is to say in particular not even if the new spool is moved from the spool store via the primary or winding position, in which the drive is coupled up and the spool is accelerated, to the secondary position on the rails. The result is therefore controlled winding from the start to the end.

The paper quality can be increased further by the mass per unit area of the web of tissue in the uncreped state lying in a range from about 11 g/m$^2$ to about 20 g/m$^2$ and in the creped state lying in a range from about 14 g/m$^2$ to about 24 g/m$^2$.

Since, above all, in the case of thin papers and in particular, in the case of "facial tissue" and "toilet" tissue, the formation, that is to say the uniformity of the fiber arrangement, plays an important part, the use of a Crescent former is of particular advantage in these cases in particular. In this case, the web is dewatered, transported, pressed and passed onto the drying cylinder or Yankee cylinder on a felt. At the start of dewatering, an outer fabric is also provided. In addition to improved formation, the result is also improved strength with possible tearing length ratios longitudinally/transversely of 1:1 to 4:1. This makes it possible to beat the fibers less. This increases the "bulk" value. By way of this former type, "strength" can be converted into "bulk". This former type improves the specific volume (bulk) by +5% in combination with at least one of the design variants described.

In this case, use can be made, in particular, of a Crescent former whose inner or carrier belt, formed by a felt, together with the web of tissue, is led over at least one evacuated device before the press nip in the web running direction. The evacuated device provided can be, in particular, a suction roll. As already mentioned, the outer belt provided in the region of the forming element of the Crescent former can in particular be formed by a wire fabric.

Also of particular advantage is, in particular, the use of a shoe press having a shoe length measured in the web running direction of greater than or equal to 80 mm and preferably greater than or equal to 120 mm. By way of the shoe press, a line force which lies in a range from 60 kN/m to about 90 kN/m is preferably produced. The maximum pressing pressure in the press nip of the shoe press is preferably less than or equal to 2 bar and preferably less than or equal to 1.5 bar. Moreover, the shoe press can comprise a shoe press unit having a blind-drilled press shell. As compared with a suction press roll, a gain in bulk in a range from about 15% to about 20% can therefore be achieved.

According to an expedient practical refinement of the method according to the invention, a drying cylinder or Yankee cylinder provided with reinforcing ribs in the interior is used, as a result of which the line force produced in the press nip can also be increased substantially above 90 kN/m. This makes the tissue machine more flexible, in particular, for the case in which, in addition to the "facial" and "toilet" tissue papers, tissue grades are also run in which the "hand feel" and the specific volume (bulk) do not have first priority but the dryness, that is to say the production level, does.

As already mentioned, a relatively thin creping doctor is preferably used. In this case, the thickness of the creping doctor can, in particular, be less than or equal to 0.9 mm.

The angle of attack between the tangent to the drying cylinder and the creping doctor is preferably less than or equal to 20°.

In the case of this creping doctor, what is known as the "rake angle" can, in particular, be greater than or equal to 15°.

According to the invention, an aim of the invention specified at the beginning can, moreover, be achieved by a machine for producing a web of tissue having a headbox and an endless carrier belt, with which the web of tissue is led through a press nip formed between a drying cylinder and a backing unit, and having a winding device for subsequently winding up the web of tissue. The headbox that is provided can be a multilayer headbox, to which at least two grades of stock can be supplied. A arrangement is preferably provided in order to influence, in particular, to control and/or regulate, the hardness of the roll produced in a predefined way as the web of tissue is wound up.

BRIEF DESCRIPTION OF THE DRAWINGS

Nonrestricting exemplary embodiments of the invention are illustrated in the drawing and will be described below. In each case in a schematic illustration.

DETAILED DESCRIPTION OF THE PRESENT INVENTION

Figure 1:
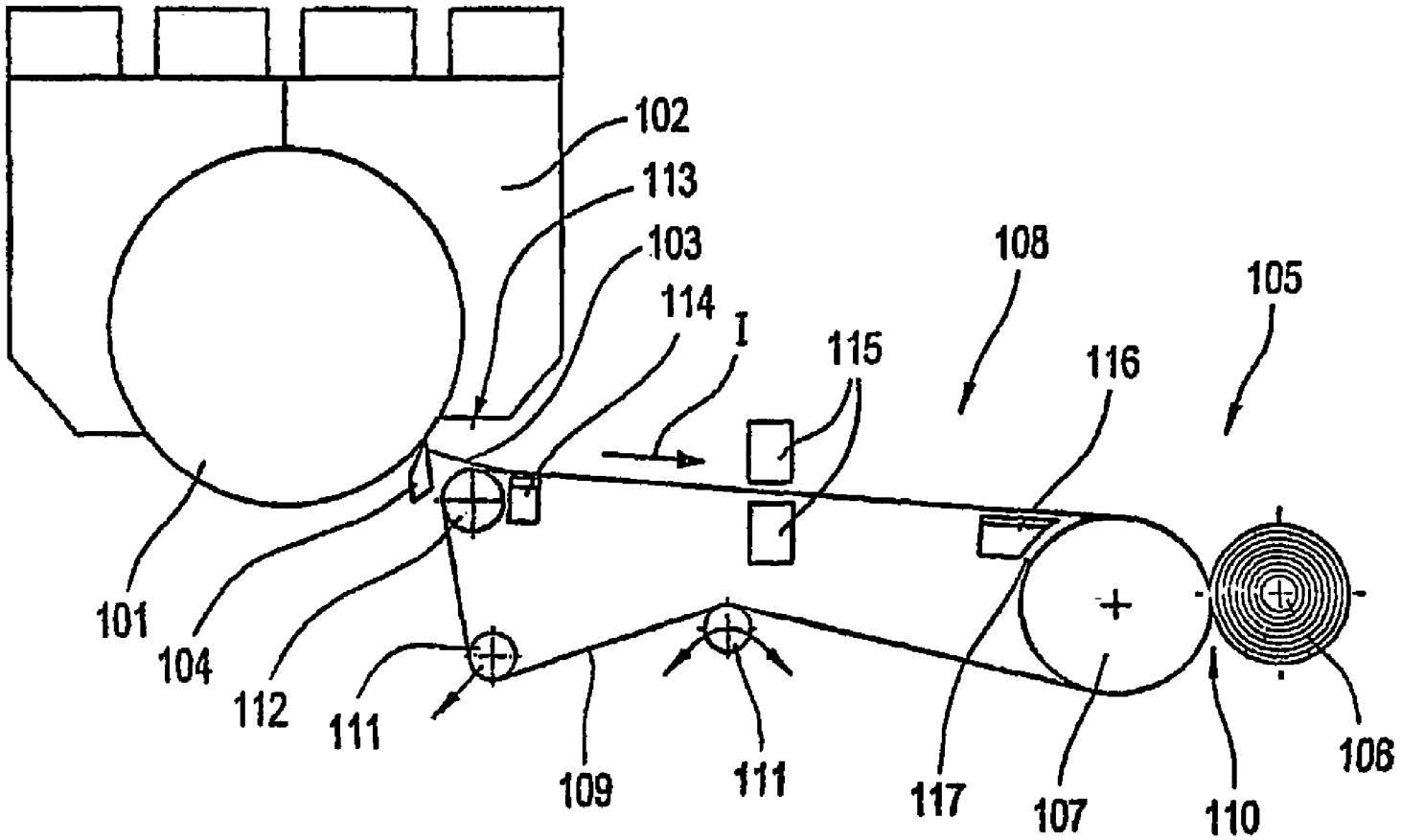
FIG. 1 shows part of a device according to the invention in a first variant.

The device illustrated in FIG. 1 comprises a drying cylinder 101, constructed as what is known as a Yankee cylinder, for example, having a drying hood 102 for drying a web of tissue 103 coming from a headbox, as is generally known for the production of webs of tissue. The web of tissue 103 is doctored off the drying cylinder 101 by way of a creping doctor 104 and supplied to a winding device 105, on which the web of tissue 103 is wound up on a spool 106. The web of tissue 103 runs over a winding drum 107, which is pressed against the spool 106. Both the winding drum 107 and the spool 106 can be driven, also at different speeds.

Between the creping doctor 104 and the winding device 105, a transfer device 108 is provided. The transfer device 108 comprises a transfer belt 109, in particular a TAD belt, which, together with the web of tissue 103, is led through the winding nip 110 between winding drum 107 and spool 106. Furthermore, the transfer belt 109 is led over deflection rollers 111 and a roll 112.

The roll 112 is located in the immediate vicinity of the creping doctor 104 and somewhat underneath the latter. As a result, the web of tissue 103 runs onto the transfer belt 109 approximately in the region of the roll 112, so that there is only a short free web draw 113 between creping doctor 104 and transfer belt 109. The web of tissue 103 is thus largely supported on its underside by the transfer belt 109 over the entire distance from creping doctor 104 to winding device 105.

Shortly after the roll 112 and underneath the transfer belt 109 there is arranged a suction box 114, in order to extract remaining moisture from the web of tissue 103. Approximately in the middle between roll 112 and winding device 105, a scanning device 115 is also provided on both sides of the web of tissue 103, in order to determine specific properties of the web of tissue 103 and/or of the transfer belt 109.

A further suction box 116 is arranged immediately before the winding drum 107. It is used to ensure that the web of tissue 103 runs onto the winding drum 107. Furthermore, under the suction box 116, an air doctor 117 is provided on the winding drum 107. By way of the air doctor 117, air carried along by the winding drum 107 is led away.

Figure 2:
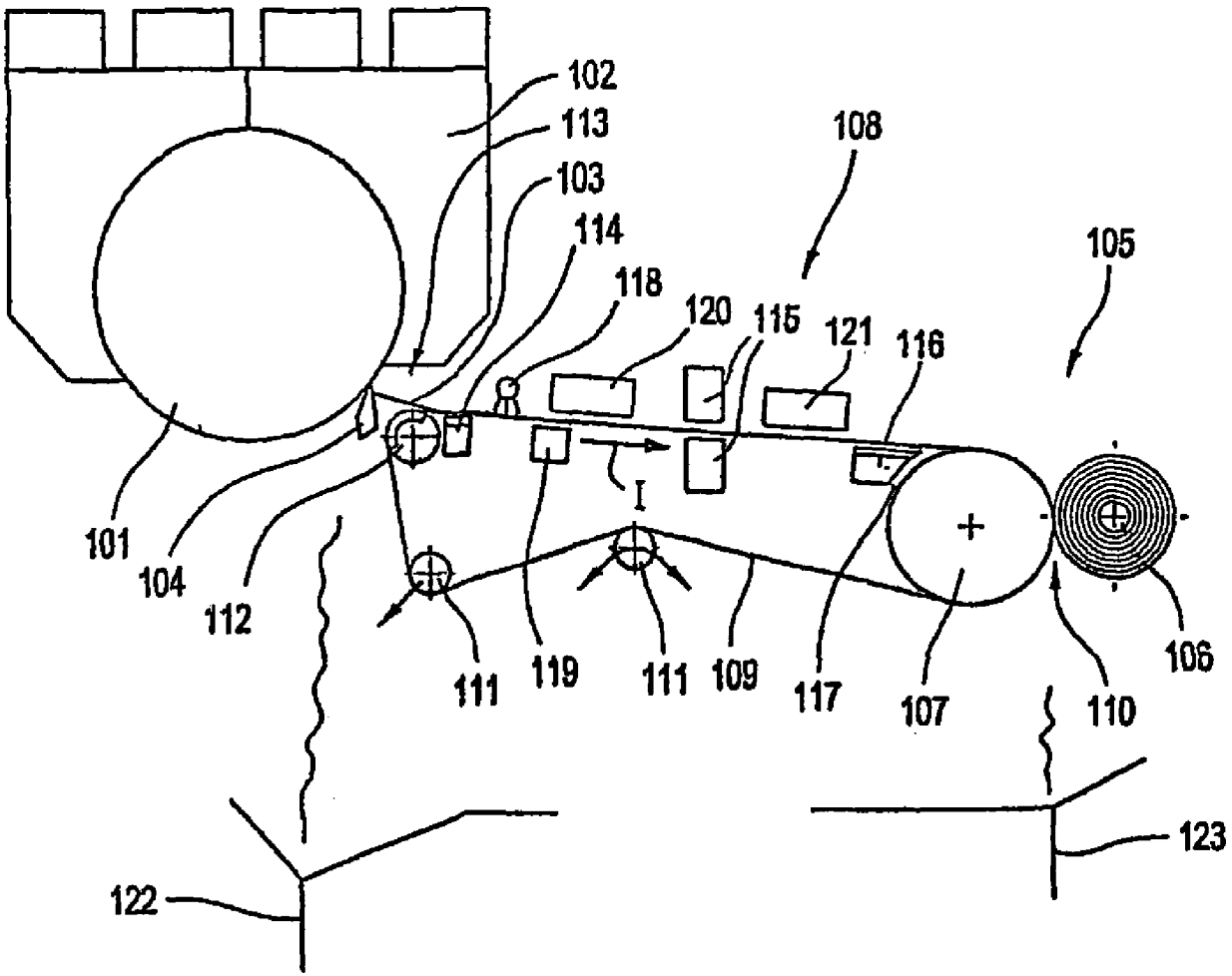
FIG. 2 shows part of a device according to the invention in a second variant.

The second variant of a device according to the invention, illustrated in FIG. 2, utilizes substantial the same features as the device illustrated in FIG. 1. However, in order to improve the transfer of the web of tissue 103 from the creping doctor 104 onto the transfer belt 109, the roll 112 is constructed as a suction roll here.

Furthermore, in this second variant, a rewetting device 118, for example, in the form a wetting shower, is provided after the first suction box 114. Arranged after the rewetting device 118 is a further suction box 119 and also a drying device 120, for example an infrared drying device. A further infrared drying device 121 is arranged after the scanner device 115.

Furthermore, in FIG. 2, a pulper 122 and 123, respectively, is arranged underneath the drying cylinder 1 and also under the winding device 105.

In addition to or instead of the suction roll 112, a blowing device can also be arranged in the region of the roll 112 in order to assist the transfer of the web of tissue 103 onto the transfer belt 109. The winding drum 107 can be uncovered or covered, for example with rubber. In addition, the winding drum can be provided with a smooth shell, a blind-drilled shell, a drilled shell or a shell provided with grooves. Blowing devices can be provided in order to carry away excess paper into the pulpers 122 and 123.

During the operation of the device according to the invention, the web of tissue 103 coming from the headbox is lead over the drying cylinder 101, where the web of tissue 103 is largely dried. The web of tissue 103 is doctored off the drying cylinder 101 by the doctor 104 and then runs with a short free web draw 113 into the transfer belt 109. By using the transfer belt 109, the web of tissue 103 is supplied to the winding device 105 and, after passing through the winding nip 110, is wound up onto the spool 106. In the process, the web of tissue 103 has vacuum applied to it by the suction box 114 and the suction box 116 and is also monitored by the scanner device 115.

In the variant illustrated in FIG. 2, the web of tissue 103 is additionally wetted by the rewetting device 119 and has vacuum applied to it by the further suction box 118. As a result, wet forming of the web of tissue can be carried out. The web of tissue 103 is then brought to a desired dryness again by the drying devices 120 and 121. Both in the case of the drying cylinder 101 and in the case of the winding device 5, excess paper is led away into the pulpers 122 and 123.

In both variants, a patterning process (patterning pressing) is carried out in the winding nip 110 on the basis of the structure of the transfer belt 109. The patterning pressing results from the fact that, in the winding nip 110, the web of tissue 103 is pressed substantially only in the elevated regions of the transfer belt 109 and otherwise remains unpressed or only slightly pressed. In this way, the quality of the web of tissue 103 can be increased, in order to achieve a high specific volume and a good hand feel.

The high quality of the web of tissue is additionally assisted by the line force in the winding nip 110 being reduced according to the invention, in particular, to 0.2 kN/m or less. This is made possible, amongst other things, by the free web draw being less than 1 m, in particular less than 0.5 m, on account of the support by the transfer belt 109. On the basis of this refinement, a threading system is likewise not needed.

The creping rate is preferably set to be between about 0% and about 50%, in particular, between about 10% and about 25%. The dryness of the web of tissue 103 at the creping doctor 104 is preferably chosen to be between about 70% and about 100%, in particular between 93% and about 98%. However, it is also possible to operate with a moist web of tissue 103.

By way of the device according to the invention, a good quality of the web of tissue 103 can be achieved with a higher production speed and runability of the device at the same time. In addition, the invention is suitable, in particular, for tissue webs of low basis weight and/or low tensile strength.

Figure 3:
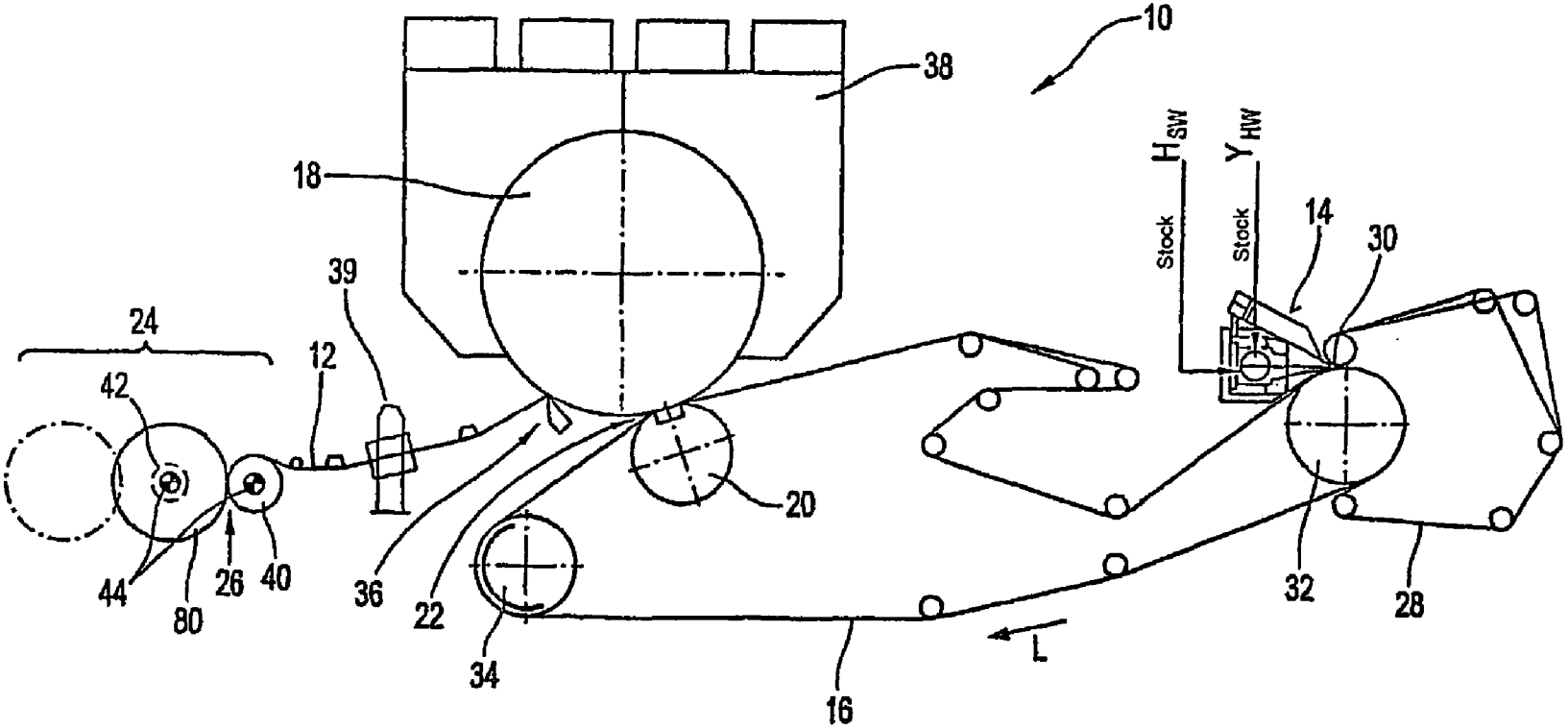
FIG. 3 shows a schematic illustration of an exemplary embodiment of a tissue machine.

FIG. 3 shows an exemplary embodiment of a machine 10 for producing a web of tissue 12 in a schematic illustration.

The tissue machine 10 comprises a headbox 14 and an endless carrier belt 16, with which the web of tissue 12 is led through a press nip 22 formed between a drying cylinder 18, a Yankee cylinder 18 here, and a backing unit 20.

Moreover, the tissue machine 10 comprises a winding device (reeler) 24 for subsequently winding up the web of tissue 12.

The headbox 14 provided is a multilayer headbox, a two-layer headbox in the present case, to which at least two different grades of stock can be supplied.

Furthermore, an arrangement described in more detail further below is provided in order to influence, that is to say, in particular, to control and/or to regulate, the hardness of the roll produced in a predefined way when winding up the web of tissue 12. In this case, the line force produced in the winding nip 26 is preferably kept less than or equal to 0.8 kN/m. A former having two circulating endless belts 16, 28 is provided. One of these two endless circulating belts 16, 28 simultaneously forms the transport belt 16.

As can be seen from FIG. 3, the two endless belts 16, 28 run together, forming a stock inlet gap 30, in order then to be led over a forming element 32, in particular, a forming or breast roll. In this case, the wrap angle with respect to the outer belt 28 is smaller than that with respect to the inner carrier belt 16.

In the present case, a Crescent former is provided, whose inner belt (carrier belt) 16 is formed by a felt.

By way of the multilayer headbox 14, different grades of stock, in the present case an HW grade of stock made of fibers from hardwood and an SW grade of stock made of fibers of softwood are introduced into the inlet gap formed between the carrier belt 16 and the outer fabric 28. The hardwood fibers can in particular be short fiber chemical pulps and the softwood fibers can in particular be long fiber chemical pulps.

After the wrap region of the forming roll 32, the web of tissue forming in this case, together with the carrier belt 16, is supplied to the press nip 22 extended in the web running direction L.

Before reaching the extended press nip 22, the carrier belt 16 carrying the web of tissue 12 with it wraps around an evacuated device, designed as a suction roll 34 here. The suction roll 34 removes a substantial part of the water from the carrier belt 16 and even somewhat from the outer web of tissue 12.

The backing unit 20 assigned to the drying cylinder 18 is formed in the present case by a shoe press unit, in particular, a shoe press roll. The press nip 22 is therefore an extended press nip of a shoe press comprising the drying cylinder 18 and the shoe press unit 20.

A creping doctor or bar 36, in particular, a thin creping doctor or bar, is assigned to the drying cylinder 18.

Following the press nip 22, the web of tissue 12 is led around the drying cylinder 18. In this case, a drying hood 38 is provided in order to intensify the drying in the relevant wrap region.

As can be seen from FIG. 3, a measuring frame 39 is provided between the drying cylinder 18 and the winding device 24. In this case, the measured values obtained can, for example, also be used for transverse profile regulation of specific web properties.

In the winding device 24, the web of tissue 12 is led first over a carrier drum 40 and then wound up onto a spool 42. Here, preferably both the carrier drum 40 and the spool 42 are each assigned a separate drive 44.

As can be seen from FIG. 3, the HW grade of stock made of short fibers obtained from hardwood is used for the layer Y facing the surface of the drying cylinder 18, and the grade of stock made of long fibers obtained from softwood is used for the layer provided on the opposite web side.

Figure 4:
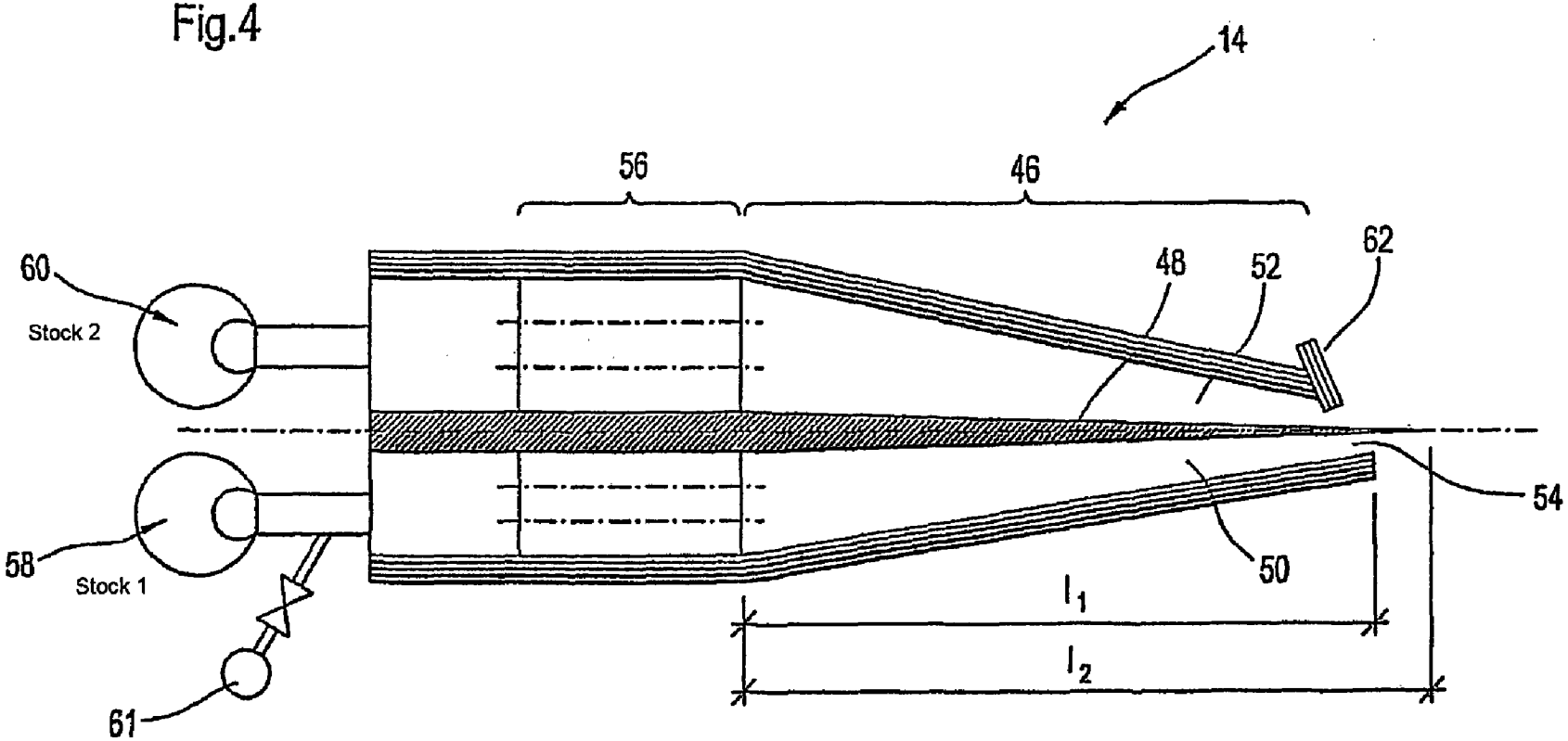
FIG. 4 shows a schematic illustration of an exemplary embodiment of a headbox of a tissue machine.

FIG. 4 shows an exemplary embodiment of the headbox 14 of the tissue machine according to the invention in a schematic illustration. In this case, the nozzle 46 of this headbox 14 is subdivided at least substantially into two channels 50, 52 by a slat 48 extending over the entire machine width. The slat 48 extends outward beyond the nozzle 46 in the region of the outlet gap 54. The quantity of the slat $I_2$ measured downstream of the turbulence generator 56 of the headbox 14, as is the nozzle length is therefore greater than the nozzle length $I_1$.

Moreover, the transverse distributor pipes 58, 60 for the two grades of stock can be seen in FIG. 4.

In the present case, moreover, sectional dilution water regulation and/or control is provided over the machine width only for the layer facing the forming roll 32 (see FIG. 3). In FIG. 4, a transverse distributor pipe 61 for dilution water, for example, can be seen.

In the region of the outlet gap 54 of the nozzle 46, one or more slices 62 can be provided. However, such slices are not imperative.

The proportion of the drying provided by the drying hood 38 for drying the web of tissue 12 is preferably greater than the proportion of the drying provided by the drying cylinder 18.

Figure 5:
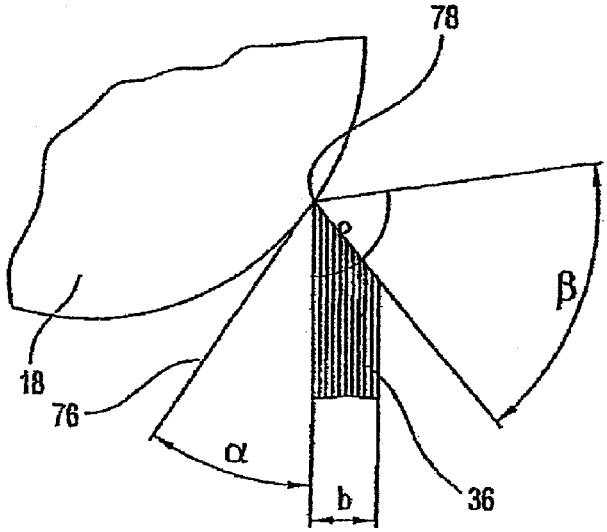
FIG. 5 shows a schematic partial illustration of a creping doctor assigned to the drying cylinder of a tissue machine.

FIG. 5 shows a creping doctor 36 assigned to the drying cylinder or Yankee cylinder 18 of the tissue machine 10 according to the invention (see FIG. 3) in a schematic partial illustration.

In the present exemplary embodiment, illustrated in FIG. 5, the thickness "b" of the creping doctor 36 is less than or equal to 0.9 mm. The angle of attack or clearance angle between the tangent 76 to the drying cylinder 18 going through the point of contact 78 and the creping doctor 36 is less than or equal to 20°. The "rake angle" of the creping doctor 36, designated " " in FIG. 3, can in particular be greater than or equal to 15°.

Figure 6:
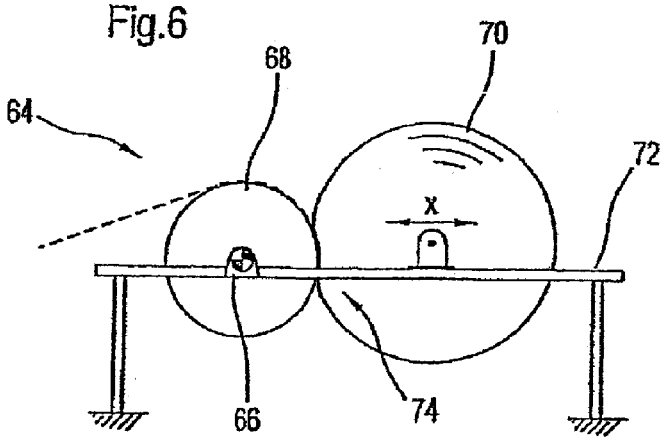
FIG. 6 shows a schematic illustration of a conventional winding device for tissue.

FIG. 6 shows a conventional winding device 64 for tissue in a schematic illustration, in which the carrier drum 68 provided with a drive 66 is pressed against the wound roll 70 onto which the web of tissue produced is wound, which means that the wound roll 70 is driven. The carrier drum 68 is fixed in location. The wound roll 70 can be moved on rails 72. The contact pressure force must be sufficiently large for the necessary drive power to be transmitted. The line force produced in the winding nip 74 is around 0.8 kN/m (width). The line force is in this case so high that the carrier drum 68 dips into the soft wound roll 70 and thus destroys or reduces the specific volume (bulk). The diameter growth of the wound roll 70 is taken into account by moving the wound roll 70 away from the carrier drum 68.

Figure 7:
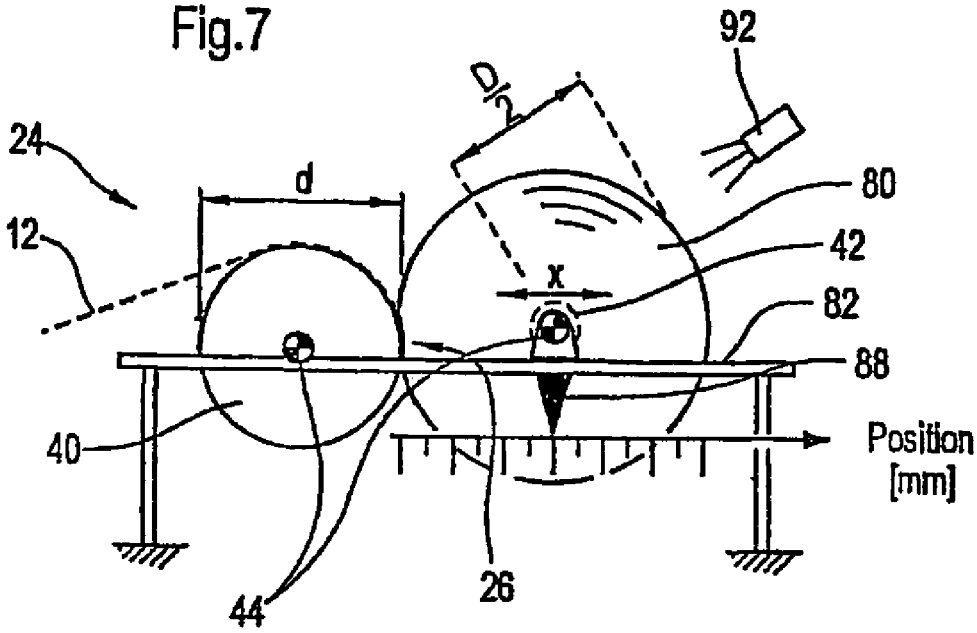
FIG. 7 shows a schematic illustration of an exemplary embodiment of a winding device of a tissue machine with movable, displacement-controlled spool and wound roll.
Figure 8:
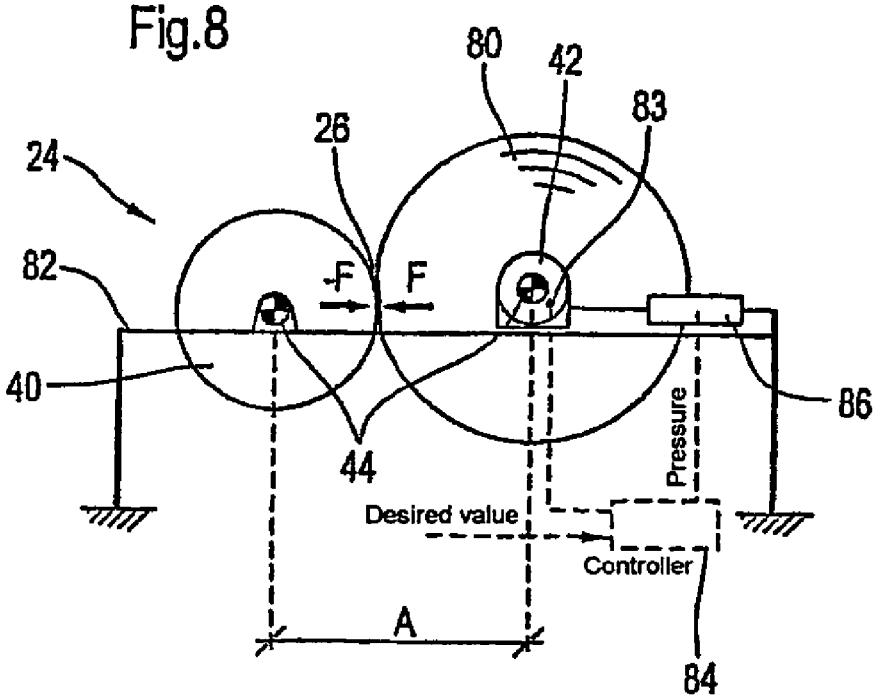
FIG. 8 shows a schematic illustration of a further exemplary embodiment of a winding device for a tissue machine with movable spool and wound roll with associated pressure and/or force sensors.

FIGS. 7 and 8 show two exemplary embodiments of the winding device 24 according to the invention in a schematic illustration.

In the respective winding device 24, the web of tissue 12 is led over a carrier roll 40 and then wound up onto a spool 42. In both embodiments, both the carrier drum 40 and the spool 42 are each assigned a drive 44.

Between the roll or wound roll 80 forming on the spool 42 and the carrier drum 40, a winding nip or contact nip 26 is formed, in which a line force is produced which critically influences the resultant winding hardness. At least the spool 42 can be moved in the x-direction, that is to say, for example, horizontally, on rails 82 or the like.

The embodiment of the winding device 24 shown in FIG. 8 is an example of one possible solution for the regulation of the line force.

In the present case, the carrier drum 40 is mounted in a fixed location on the rails 82. By contrast, the spool 42 and, in a corresponding way, the wound roll 80 formed thereon, can move or can be moved. In this case, the spool 42 can be changed in its position, for example, by way of translational actuators provided on both sides, such as threaded rods with associated motor, hydraulic cylinders, and so on.

Preferred criteria for the translation or displacement of the spool 42 and the roll 80 formed thereon are the growth in the roll diameter D and the line force in the winding nip 26.

In this embodiment, both criteria can be satisfied with one control loop.

Sensors 83, which measure the nip force F in the region of the press nip 26 directly or indirectly can be integrated in the bearings of the spool 42. The aforementioned sensors can be, for example, pressure sensors, force sensors, strain gages and so on.

If, for example, the measured force deviates from the predefined force, that is to say a corresponding desired value, then the pressure of a relevant hydraulic cylinder, for example, is changed via a controller 84, for example, by a hydraulic unit, in such a way that the difference between the desired value and the measured value becomes "zero".

Of course, a modification of this embodiment in which only the carrier drum 40 or both the carrier drum 40 and the spool 42 can be moved or displaced is also conceivable. In the case of a movable carrier drum 40, this has the relevant sensors via which the nip force F is regulated.

The displacement of the wound roll in this case compensates only for the growth in the roll diameter D.

The distance between the axes of the carrier drum 40 and the spool 42 or the wound roll 80, which becomes increasingly larger during the winding operation, is designated "A" in FIG. 8.

In the case of low line forces and large, heavy wound rolls, it is possible for the case to occur in which the measurement accuracy of the sensors and the setting accuracy (friction) are no longer adequate.

In particular, in the case of line forces in the winding nip 26 which are less than or equal to 0.5 kN/m and in particular less than or equal to 0.2 kN/m, for example, the movable spool and, in a corresponding way, the wound roll 80 formed thereon are preferably designed to be displacement-controlled. The design shown in FIG. 5 is an appropriate embodiment.

The measured variables provided for this displacement control are, in particular, the following variables:

diameter D of the wound roll 80; and position of the wound roll 80 or of the spool 42 relative to the carrier drum 40.

In this case, the position of the wound roll 80 can be measured by sensors such as LVDTs (linear variable differential transformer), and the diameter of the wound roll can be determined by a distance sensor, for example, optically or acoustically. The actuators 86 (see FIG. 6), which can be hydraulic cylinders and so on, for example, position the wound roll 80 accurately in such a way that, for example, the latter just touches the carrier drum 40. In this case, the line force $F_L$ produced in the winding nip 26 is therefore equal to zero. If $F_L$ is to be >0 kN/m, then the wound roll 80 can be moved further onto the carrier drum 40 by a predefinable distance which, in particular, depends on the softness of the wound roll 80. This therefore produces a slight desired pressure in the press nip or contact nip 26 of, for example, $F_L \leqq 0.2$ kN/m. The distance A (see also FIG. 6) is therefore $A<d/2+D/2$ or $A=d/2+D/2-x$, where "x" is a measure of the extent to which the carrier drum 40 dips into the roll 80 formed on the spool 42.

A further possible way of monitoring and setting the nip force results, for example, from observing the nip region with a CCD camera. Therefore, in particular, the distance between the carrier drum 40 and the wound roll 80 can be measured and displayed. By using an appropriate evaluation of the image obtained, a desired value, for example for a hydraulic cylinder pressure, can then again be calculated and effect the displacement as far as the desired distance or nip force via a control device. The gain in bulk lies in a range from 4 to 8%.

In order to illustrate the displacement control, in the illustration according to FIG. 7, the spool 42 is assigned a pointer 88, whose position with respect to a stationary scale 90 ultimately indicates the position of the spool 42 and therefore of the roll 80 formed on the latter.

Moreover, in FIG. 7 it is possible to see a sensor 92 which, in particular, is a sensor of the type mentioned previously, for example only a CCD camera or the like.

Figure 9:
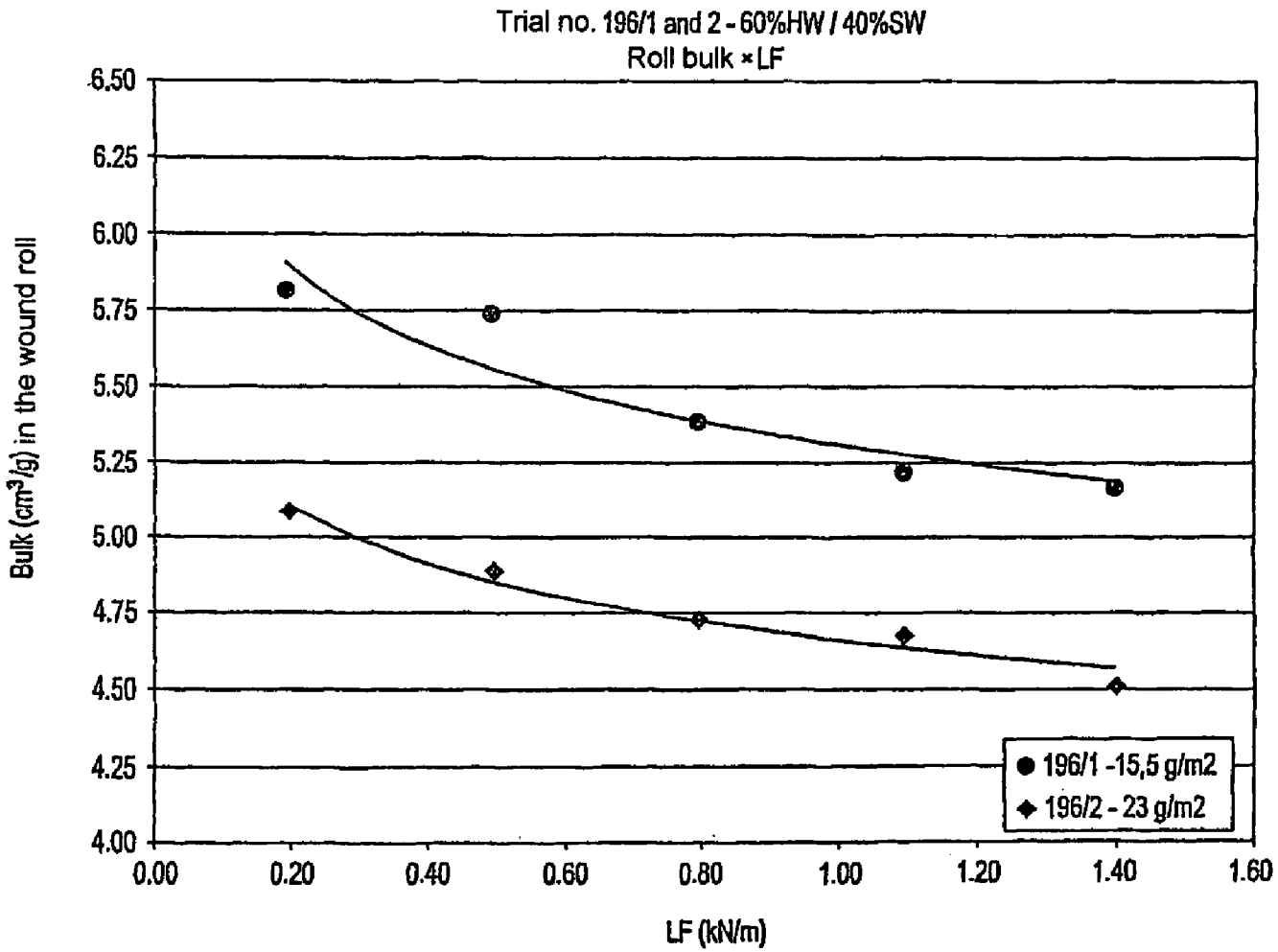
FIG. 9 shows a graph which reproduces the influence of the line force in the winding nip on the specific volume (bulk) of the web of tissue in the wound roll.

FIG. 9 shows a graph which reproduces the influence of the line force $L_F$ in the winding nip on the specific volume (bulk) of the web of tissue in the wound roll. "HW" designates a grade of stock made from hardwood fibers, and "SW" designates a grade of stock made from softwood fibers.

Figure 10:
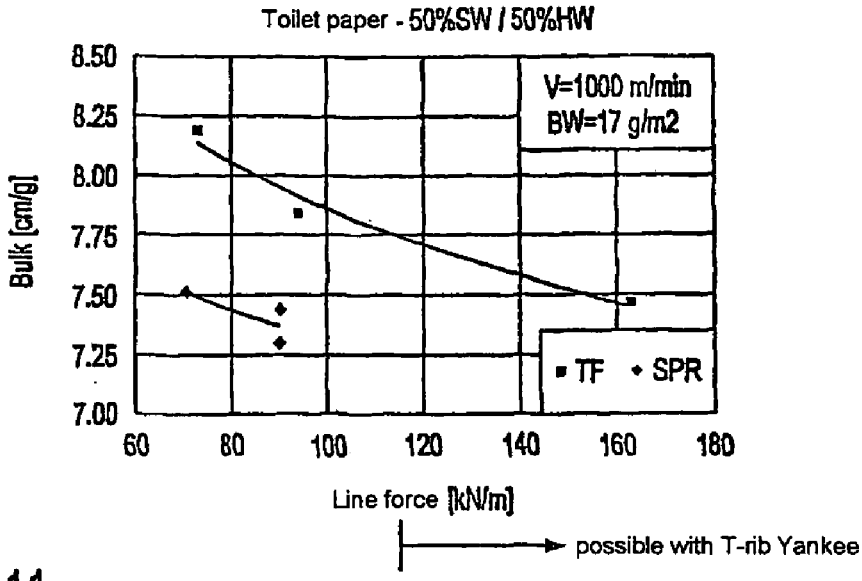
FIG. 10 shows a graph which, in comparison with a suction press roll (SPR), reproduces the influence of a shoe press (TF) on the specific volume (bulk) as a function of the line force of the press, what is known as a T-rib Yankee cylinder, i.e. a Yankee cylinder provided with internal reinforcing ribs, being used from 90 kN/m onward.

FIG. 10 shows a graph which, in comparison with a suction press roll (SPR), reproduces the influence of a shoe press (TF) provided according to the invention on the specific volume (bulk) as a function of the line force of the press. In this case, beginning at 90 kN/m, what is known as a "T-rib" Yankee cylinder, that is to say a Yankee cylinder provided with internal reinforcing ribs, is used.

Figure 11:
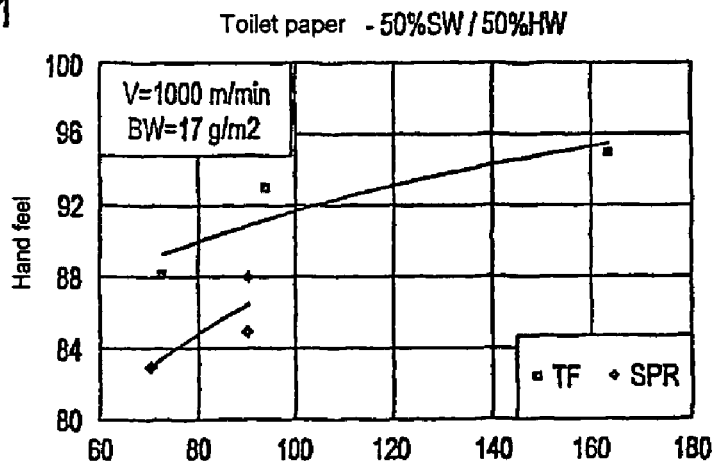
FIG. 11 shows a graph comparable with the graph of FIG. 8 but in this case for the "hand feel"

FIG. 11 shows a graph comparable with the graph of FIG. 10, but in this case for the "hand feel" already mentioned at the beginning.

Figure 12:
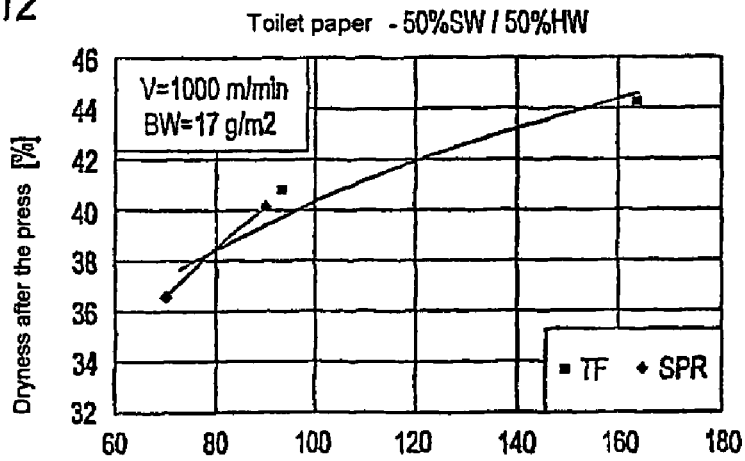
FIG. 12 shows a graph comparable with the graph of FIG. 8 but in this case for the dryness after the press.

FIG. 12 also again shows a graph comparable with the graph of FIG. 10, but in this case for the dryness after the press.

Figure 13:
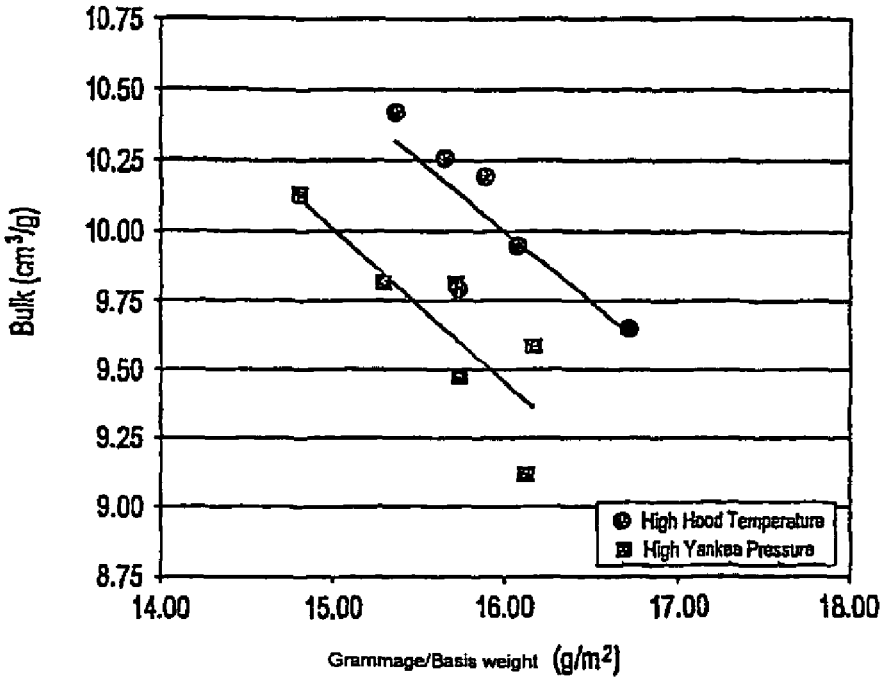
FIG. 13 shows a graph which reproduces the influence of drying conditions, such as in particular the drying ratio Yankee cylinder/drying hood.

The graph of FIG. 13 reproduces the influence of drying conditions, such as, in particular, the drying ratio Yankee cylinder/drying hood.

Figure 14:
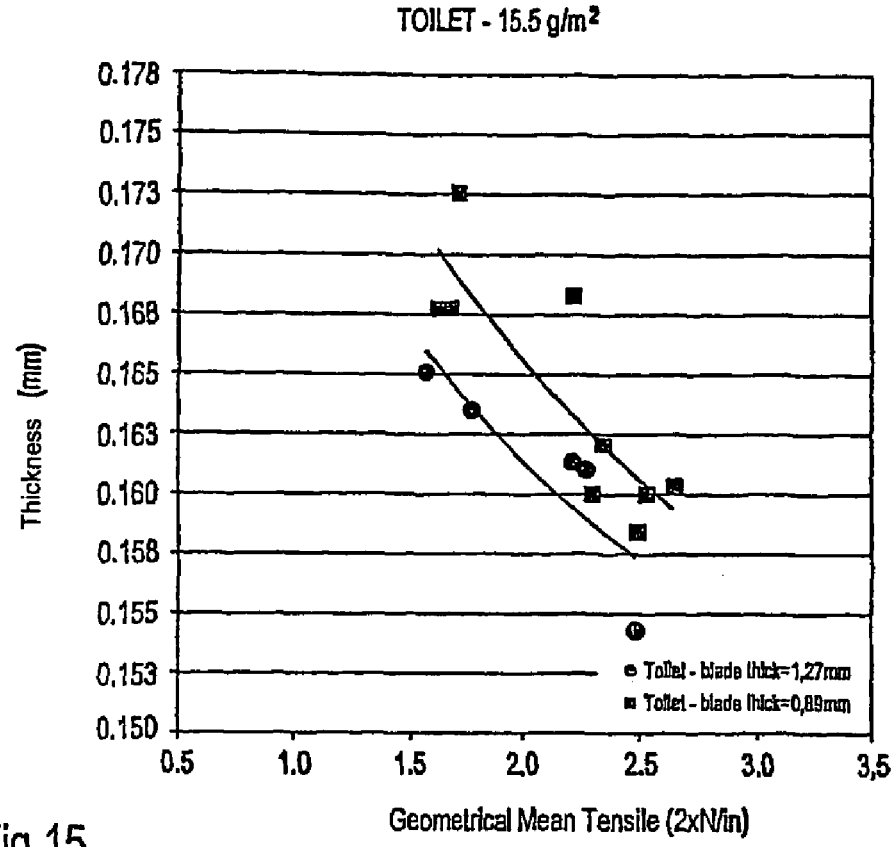
FIG. 14 shows a graph which reproduces the influence of the thickness of the creping doctor on the thickness of the tissue paper (bulk)

The graph of FIG. 14 shows the influence of the thickness of the creping doctor on the thickness of the tissue paper, which here corresponds to the specific volume (bulk). On the other hand, an improved "hand feel" value at a constant "bulk" value is also possible. In the graph, the abbreviation "GMT" stands for the English expression "geometric mean tensile" (geometric average of the strength).

Figure 15:
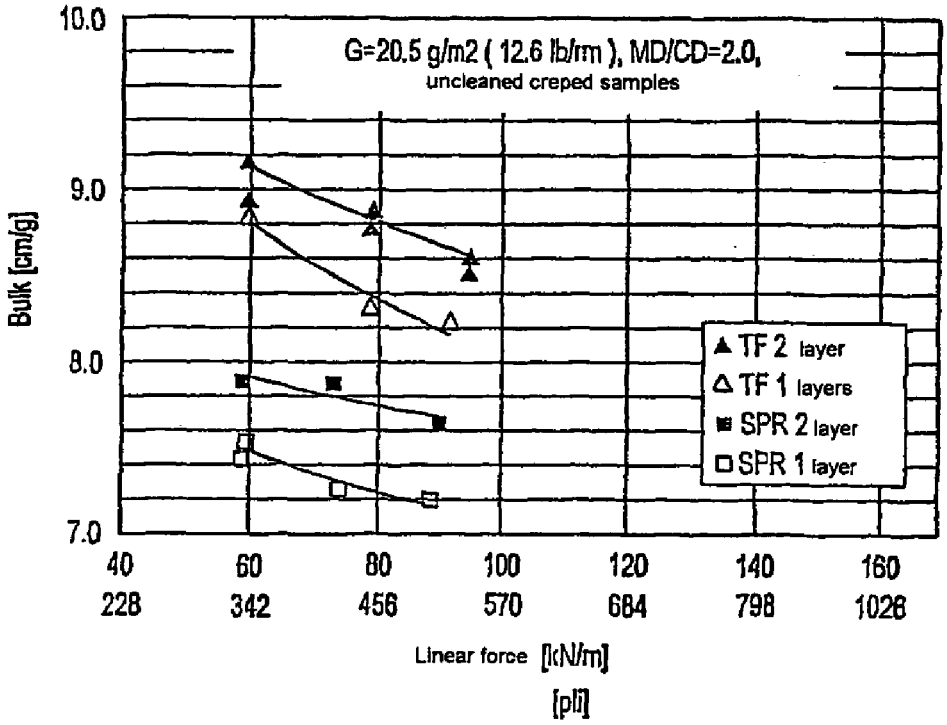
FIG. 15 shows a graph which reproduces the influence of the multilayer production of the tissue paper on the specific volume (bulk) in the case of different presses, it being possible in particular to see the advantage that results when a shoe press (TF) is used as compared with a suction press roll (SPR).

FIG. 15 shows a graph which reproduces the influence of the multilayer production of the tissue paper on the specific volume (bulk) in the case of different presses, it being possible in particular to see the advantage that results with the use of a shoe press (TF) as compared with a suction press roll (SPR).

| List of designations | |
|---|---|
| 10 | Tissue machine |
| 12 | Web of tissue |
| 14 | Headbox |
| 16 | Endless circulating belt, carrier belt |

-continued

| List of designations | |
|---|---|
| 18 | Drying cylinder, Yankee cylinder |
| 20 | Backing unit, shoe press unit |
| 22 | Press nip, contact nip |
| 24 | Winding device, reeler |
| 26 | Winding nip |
| 28 | Endless circulating belt, outer fabric |
| 30 | Stock inlet gap |
| 32 | Forming element, forming roll, breast roll |
| 34 | Evacuated device, suction roll |
| 36 | Creping doctor, doctor bar |
| 38 | Drying hood |
| 39 | Measuring frame |
| 40 | Carrier drum |
| 42 | Spool |
| 44 | Drive |
| 46 | Nozzle |
| 48 | Slat |
| 50 | Channel |
| 52 | Channel |
| 54 | Outlet gap |
| 56 | Turbulence generator |
| 58 | Transverse distributor pipe |
| 60 | Transverse distributor pipe |
| 61 | Transverse distributor pipe |
| 62 | Slice |
| 64 | Winding device, reeler |
| 66 | Drive |
| 68 | Carrier drum |
| 70 | Wound roll |
| 72 | Rails |
| 74 | Winding nip |
| 76 | Tangent |
| 78 | Point of contact |
| 80 | Roll, wound roll |
| 82 | Rails |
| 83 | Sensor |
| 84 | Controller |
| 86 | Actuator |
| 88 | Pointer |
| 90 | Scale |
| 92 | Sensor |
| 101 | Drying cylinder |
| 102 | Drying hood |
| 103 | Web of tissue |
| 104 | Creping doctor |
| 105 | Winding device |
| 106 | Spool |
| 107 | Winding drum |
| 108 | Transfer means |
| 109 | Transfer belt |
| 110 | Winding nip |
| 111 | Deflection roller |
| 112 | Roll |
| 113 | Free web draw |
| 114 | Suction box |
| 115 | Scanner device |
| 116 | Suction box |
| 117 | Air doctor |
| 118 | Rewetting device |
| 119 | Suction box |
| 120 | Infrared drying device |
| 121 | Infrared drying device |
| 122 | Pulper |
| 123 | Pulper |
| I | Web running direction |
| A | Distance |
| D | Roll diameter |
| F | Nip force, force in the winding nip |
| b | Thickness |
| $I_1$ | Nozzle length |
| $I_2$ | Slat length |
| α | Angle of attack, clearance angle |
| β | "Rake angle" |

The invention claimed is:

1. A device for producing a tissue web comprising:

at least one drying cylinder;

a creping doctor arranged on the at least one drying cylinder;

a winding device for winding up the tissue web;

the winding device comprising a winding nip formed between a winding drum and a spool;

a transfer device at least largely bridging an entire distance between the creping doctor and the winding device and moves around the winding drum of the winding device;

a free web draw arranged between the creping doctor and the winding device; and a mechanism for at least one of controlling and measuring a line force in the winding nip, wherein the tissue web is supported only on its underside by the transfer device over an entire distance from where the tissue web first contacts the transfer device to the winding nip, and wherein the line force is less than or equal to 0.8 kN/m.

2. The device of claim 1, wherein the free web draw is one of:

<1 m; and

<0.5 m.

3. The device of claim 1, wherein the transfer device begins to support the tissue web underneath the creping doctor.

4. The device of claim 1, wherein the transfer device comprises one of:

a belt;

an embossing belt;

a felt;

an embossing felt;

a membrane;

a Spectra membrane;

a structured material; and a TAD belt.

5. The device of claim 1, wherein the spool is one of a driven spool and a spool having displacement control and wherein the transfer device is led through the winding nip of the winding device with the tissue web.

6. The device of claim 1, further comprising a device which subjects the tissue web to a patterning in the winding nip of the winding device.

7. The device of claim 1, wherein the line force is about 0.2 kN/m.

8. The device of claim 1, further comprising one of:

a device for subjecting the tissue web to wet formation arranged between the at least one drying cylinder and the winding device;

a device for rewetting and applying a vacuum to the tissue web arranged between the at least one drying cylinder and the winding device;

a device for rewetting and a device for applying a vacuum to the tissue web arranged between the at least one drying cylinder and the winding device;

a device for rewetting and a device for applying a vacuum to the tissue web arranged between the at least one drying cylinder and the winding device, the rewetting device being arranged on an upper side of the tissue web and the device for applying vacuum being arranged on an underside of the tissue web; and a device for rewetting, a device for applying a vacuum, and a device for drying the tissue web arranged between the at least one drying cylinder and the winding device, the drying device is arranged after the rewetting device and the device for applying a vacuum.

9. The device of claim 1, further comprising at least one of:

at least one infrared drying device; and a drying hood.

10. The device of claim 1, wherein the tissue web has, at the creping doctor, one of:

a dryness of between about 70% and about 100%; and a dryness of between about 93% and about 98%.

11. The device of claim 1, wherein a creping rate is one of:

between about 0% and about 50%; and between about 10% and about 25%.

12. The device of claim 1, wherein the device does not utilizes a threading system.

13. The device of claim 1, further comprising one of:

a device for applying vacuum to the tissue web positioned after the creping doctor; and a device for blowing on the tissue web positioned after the creping doctor.

14. The device of claim 1, wherein the winding drum comprises one of:

an uncovered winding drum;

a covered winding drum;

a winding drum having a smooth shell;

a winding drum having a blind-drilled shell;

a winding drum having a drilled shell; and a winding drum having a shell with grooves.

15. The device of claim 1, further comprising one of:

a pulper arranged under the at least one drying cylinder;

a pulper arranged under the winding device; and a device for blowing off excess paper present on a winding drum of the winding device into a pulper.

16. The device of claim 1, further comprising one of:

an air deflector arranged on a winding drum of the winding device; and a doctor arranged on a winding drum of the winding device.

17. The device of claim 1, wherein the tissue web has at least one of:

a low basis weight; and a low tensile strength.

18. The device of claim 1, further comprising:

a headbox;

an endless carrier belt; and a press nip formed between the at least one drying cylinder and a backing unit.

19. The device of claim 18, wherein the headbox comprises a multilayer headbox, to which at least two grades of stock can be supplied, and further comprising one of:

a device for influence a hardness of a roll upon which the tissue web is wound;

a device for controlling a hardness of a roll upon which the tissue web is wound; and a device for regulating a hardness of a roll upon which the tissue web is wound.

20. The device of claim 1, wherein the at least one drying cylinder is a Yankee cylinder.

21. The device of claim 1, further comprising:

a former having two circulating endless belts which run together and form a stock inlet gap, the two circulating endless belts being led over a forming element such an inner belt of the two circulating endless belts comes into contact with the forming element.

22. The device of claim 1, further comprising a Crescent former and a felt for forming the tissue web.

23. The device of claim 1, wherein the tissue web is led through at least one shoe press on a carrier belt.

24. The device of claim 1, further comprising one of:

a backing unit assigned to the at least one drying cylinder; and a shoe press unit arranged at the at least one drying cylinder.

25. The device of claim 1, further comprising a drying hood and a press nip arranged at the at least one drying cylinder.

26. The device of claim 1, further comprising one of:

a multilayer headbox subdivided into at least two channels by at least one slat extending over an entire machine width;

a multilayer headbox subdivided at least substantially symmetrically into two channels by a slat;

a multilayer headbox subdivided at least substantially symmetrically into two channels by a slat that extends outward beyond a nozzle in a region of an outlet gap;

a multilayer headbox equipped with sectional dilution water regulation over a machine width; and a multilayer headbox equipped with sectional dilution water control over a machine width.

27. The device of claim 1, wherein the tissue web is formed with one of:

at least two layers utilizing sectional dilution water regulation and/or control in the headbox; and at least one layer utilizing sectional dilution water regulation and/or control in the headbox, whereby the at least one layer faces a forming roll.

28. The device of claim 1, wherein the tissue web is subjected to greater drying by a drying hood than the at least one drying cylinder.

29. The device of claim 28, wherein a ratio of the proportion of the drying by the drying hood and the proportion of the drying with the at least one drying cylinder is one of:

greater than 55:45;

greater than or equal to 60:30;

greater than or equal to 65:35; and greater than or equal to 70:30.

30. The device of claim 1, further comprising a drying hood operating one of:

at a temperature that is greater than or equal to 400° C.;

at a temperature that is greater than or equal to 500° C.;

at a temperature that is greater than or equal to 600° C.; and at a temperature that is greater than or equal to 700° C.

31. The device of claim 1, wherein the at least one drying cylinder utilizes a steam pressure in the at least one drying cylinder that is one of:

less than or equal to 0.7 MPa;

less than or equal to 0.6 MPa; and less than or equal to 0.5 MPa.

32. The device of claim 1, further comprising one of:

the tissue web being moved over a carrier drum of the winding device and then wound up onto the spool of the winding device; and the tissue web being moved over a driven carrier drum of the winding device and then wound up onto the spool of the winding device and the spool is a driven spool.

33. The device of claim 32, wherein the line force in the winding nip between the carrier drum and the spool is one of:

less than or equal to 0.5 kN/m; and less than or equal to 0.2 kN/m.

34. The device of claim 32, wherein a maximum difference between a circumferential speed of the spool and a circumferential speed of the carrier drum is less than 10%.

35. The device of claim 1, further comprising one of:

an arrangement for maintaining the free web draw and a drive assigned to the winding drum, the free web draw being maintained irrespective of the line force produced in the winding nip;

an arrangement for controlling the free web draw and a drive assigned to the winding drum, the free web draw being controlled irrespective of the line force produced in the winding nip;

an arrangement for regulating the free web draw and a drive assigned to the winding drum, the free web draw being controlled irrespective of the line force produced in the winding nip;

an arrangement for controlling the free web draw between the at least one drying cylinder and the winding drum via a drive assigned to the winding drum as a function of a speed of the winding drum; and an arrangement for regulating the free web draw between the at least one drying cylinder and the winding drum via a drive assigned to the winding drum as a function of a speed of the winding drum.

36. The device of claim 1, wherein the winding drum is a carrier drum and the spool is a movable spool and one of:

the winding device comprises the carrier drum mounted in a fixed location and the movable spool;

the winding device comprises the carrier drum mounted in a fixed location and the movable spool, whereby movement of the spool compensates for an increase in roll diameter of the spool;

the winding device comprises the carrier drum mounted in a fixed location and the movable spool, whereby the line force in the winding nip of the winding device is set via the movable spool;

the winding device comprises the carrier drum mounted in a fixed location and the movable spool, whereby the line force in the winding nip of the winding device and a growth of a diameter of the spool is set and compensated for using a common control loop; and the winding device comprises the carrier drum mounted in a fixed location and the movable spool, whereby the line force in the winding nip of the winding device is determined via at least one force sensor.

37. The device of claim 1, wherein the winding drum is a carrier drum and the spool is a movable spool, and wherein the line force is one of:

less than or equal to 0.5 kN/m; and less than or equal to 0.2 kN/m.

38. The device of claim 1, wherein the winding drum is a carrier drum and the spool is a movable spool, and wherein a displacement of the spool is controlled by measuring one of:

a roll diameter of the spool;

a position of the spool relative to the carrier drum;

a position of the spool utilizing sensors; and a position of the spool utilizing LVDT (linear variable differential transformer) sensors.

39. The device of claim 1, wherein the winding drum is a carrier drum and the spool is a movable spool, and wherein one of:

the line force in the winding nip of the winding device is set and controller and a region of the winding nip is monitored with a CCD camera;

the line force in the winding nip of the winding device is set and controlled and a region of the winding nip is monitored with a CCD camera; and a CCD camera registers a distance between the carrier drum and the spool.

40. The device of claim 1, wherein the tissue web has a mass per unit area in an uncreped state that is in the range of between about 11 $g/m^2$ to about 20 $g/m^2$ and in a creped state is in the range of between about 14 $g/m^2$ to about 24 $g/m^2$.

41. The device of claim 1, further comprising one of:

a Crescent formed for forming the tissue web, wherein the tissue web is moved with a felt over the Cresent former and then over at least one evacuated device, and thereafter moved through a press nip formed by the at least one drying cylinder;

a Crescent former for forming the tissue web, wherein the tissue web is moved with a felt over the Cresent former and then over a suction roll, and thereafter through a press nip formed by the at least one drying cylinder; and a Crescent former and a felt for forming the tissue web, wherein the tissue web is move from the Crescent former to an evacuation device, and thereafter through a press nip formed by the at least one drying cylinder.

42. The device of claim 1, further comprising a shoe press arranged at the at least one drying cylinder, wherein the shoe press has a shoe length measured in a web running direction that is one of:

greater than or equal to 80 mm; and greater than or equal to 120 mm.

43. The device of claim 1, further comprising a shoe press arranged at the at least one drying cylinder and one of:

a line force being produced in the shoe press which is in the range of between about 60 kN/m to about 90 kN/m;

a maximum pressing pressure being produced in the shoe press that is less than or equal to 2 bar; and a maximum pressing pressure being produced in the shoe press that is less than or equal to 1.5 bar.

44. The device of claim 1, further comprising a shoe press arranged at the at least one drying cylinder, wherein the shoe press comprises a shoe press unit having a blind-drilled press shell.

45. The device of claim 1, wherein the at least one drying cylinder comprises one of:

a Yankee cylinder; and a Yankee cylinder with reinforcing ribs in an interior thereof.

46. The device of claim 1, wherein the creping doctor comprises a thickness that is less than or equal to 0.9 mm.

47. The device of claim 1, wherein an angle of attack between a tangent of the at least one drying cylinder and the creping doctor is less than or equal to 20°.

48. The device of claim 1, wherein a rake angle (β) of the creping doctor is greater than or equal to 15°.

49. The device of claim 1, further comprising one of:

a device for compensating automatically for a growth of a roll diameter of the spool of the winding device; and a device for automatically setting the line force in the winding nip of the winding device.

50. The device of claim 1, wherein the transfer device is a single transfer belt.

51. The device of claim 1, wherein only the free web draw is arranged between the creping doctor and the transfer device.

52. The device of claim 51, wherein the transfer device is a single transfer belt which supports the tissue web from underneath.

53. The device of claim 1, wherein the tissue web is largely supported on its underside by the transfer device over an entire distance from the creping doctor to the winding nip, and, after moving around the winding drum, returns to a position where the free web draw meets the transfer device.

54. The device of claim 53, wherein the transfer device is a single transfer belt.

55. The device of claim 1, wherein the transfer device is a single transfer belt which supports the tissue web from underneath and wherein the free web draw is a short free wed draw arranged between the creping doctor and the transfer belt.

56. The device of claim 55, further comprising a scanning device arranged over the single endless belt.

57. The device of claim 56, wherein an upper surface of the tissue web is exposed over an entire distance from where the tissue web first contacts the transfer belt to the winding device.

58. The device of claim 1, wherein an upper surface of the tissue web is exposed over an entire distance from where the tissue web first contacts the transfer belt to the winding device.

59. The device of claim 58, wherein the transfer device is a single endless belt that, after moving around the winding drum, returns to a position where the free web draw meets the transfer belt.

60. The device of claim 1, wherein the free web draw spans an entire distance between the creping doctor and the transfer device, wherein the transfer device is a single endless transfer belt, and wherein the tissue web is transported the entire distance from where the tissue web first contacts the transfer belt to the winding device using only the single transfer belt.

61. The device of claim 1, wherein the free web draw spans an entire distance between the creping doctor and the transfer device, and wherein the transfer device is a single endless transfer belt.

62. A device for producing a tissue web comprising:

at least one drying cylinder;

a creping doctor arranged on the at least one drying cylinder;

a winding device for winding up the tissue web;

the winding device comprising a winding nip formed between a winding drum and a spool;

a transfer belt at least largely bridging an entire distance between the creping doctor and the winding device and moving around the winding drum of the winding device;

a free web draw arranged between the creping doctor and the winding device; and a mechanism for at least one of controlling and measuring a line force in the winding nip, wherein the tissue web is supported on only on its underside by the transfer belt between the free web draw and the winding nip and the tissue web has an opposite unsupported side between the creping doctor and the winding device, and wherein the line force is less than or equal to 0.8 kN/m.

63. The device of claim 62, wherein the free web draw spans an entire distance between the creping doctor and the transfer belt, wherein the transfer belt is a single endless transfer belt, and wherein the tissue web is transported the entire distance from where the tissue web first contacts the transfer belt to the winding device using only the single transfer belt.

* * * * *